US005516039A

United States Patent [19]

Kirchhoff

[11] Patent Number: 5,516,039

[45] Date of Patent: May 14, 1996

[54] CARTON BLANK

[75] Inventor: Amy Kirchhoff, Boulder, Colo.

[73] Assignee: Graphic Packaging Corporation, Paoli, Pa.

[21] Appl. No.: 431,676

[22] Filed: May 2, 1995

[51] Int. Cl.[6] ..... B65D 5/4805

[52] U.S. Cl. ..... 229/162; 229/110; 229/120.15; 229/161

[58] Field of Search ..... 229/162, 110, 229/120.15, 161; 206/45.31, 430

[56] References Cited

U.S. PATENT DOCUMENTS

| | | | |
|---|---|---|---|
| 2,321,473 | 6/1943 | Ferguson | 229/161 X |
| 2,902,200 | 9/1959 | Manners | 229/162 X |
| 3,014,637 | 12/1961 | Wilson | 229/110 |
| 3,089,632 | 5/1963 | Bartolucci | 229/162 X |
| 4,601,390 | 7/1986 | Rosenthal | 229/110 X |
| 5,011,070 | 4/1991 | Plunkett | 229/162 X |
| 5,050,775 | 9/1991 | Marquardt | 229/110 X |

FOREIGN PATENT DOCUMENTS

| | | | |
|---|---|---|---|
| 992231 | 6/1962 | United Kingdom | 206/45.31 |
| 1192032 | 6/1967 | United Kingdom | 229/120.15 |

*Primary Examiner*—Gary E. Elkins
*Attorney, Agent, or Firm*—Klaas, Law, O'Meara & Malkin; Joseph J. Kelly

[57] ABSTRACT

A carton for holding a plurality of filled containers in an end to end relationship formed from a unitary sheet of paperboard provided with cut and fold lines to divide the unitary sheet into a plurality of lengthwise extending sidewall panels and end flaps joined to each end portion of the lengthwise extending panels by fold lines and wherein a plurality of partially cut-out portions are formed in the lengthwise extending sidewall panels with spacer panels detachably secured to some of the lengthwise extending sidewall panels and joined to as associated lengthwise extending panel by a fold line so that the spacer panels may be folded to locations between adjacent ends of adjacent filled containers.

18 Claims, 1 Drawing Sheet

CARTON BLANK

FIELD OF THE INVENTION

This invention relates generally to carton blanks for forming cartons for holding filled containers and more particularly to a carton blank for forming a carton for holding filled containers in an end to end relationship.

BACKGROUND OF THE INVENTION

The variety of cartons that have been used in the marketing of beverage containers is so numerous that it is hard to imagine the actual numbers. This is probably due to competition that provides the impetus for manufacturers to devise new and attractive cartons to gain a desired share of the market. Accordingly, this invention provides a carton blank for forming a carton for the marketing of beverage containers in an attractive carton to please a purchaser.

BRIEF DESCRIPTION OF THE INVENTION

This invention provides a carton blank for forming a carton for holding filled containers, particularly for a beverage, in an end to end relationship and wherein portions of the beverage containers are visible to the purchaser.

In a preferred embodiment of the invention, the carton blank comprises a unitary sheet of a paperboard material having a length and a width. A plurality of cut lines and fold lines are formed in the unitary sheet for dividing the unitary sheet into a plurality of lengthwise extending sidewall panels and a lengthwise extending glue tab panel. An end flap is joined to each end portion of each of the plurality of lengthwise extending sidewall panels by a fold line. A plurality of spaced apart at least partially cut-out portions are formed in the unitary sheet and at least a portion of each of the plurality of spaced apart at least partially cut-out portions are located in a widthwise direction in a plurality of the plurality of lengthwise extending sidewall panels. Each of the plurality of spaced apart at least partially cut-out portions has a central portion located in one of the plurality of lengthwise extending sidewall panels and opposite side portions located in adjacent ones of the plurality of lengthwise extending sidewall panels. At least a plurality of the central portions are located in at least one of the plurality of lengthwise extending sidewall panels. The plurality of lengthwise extending sidewall panels are six in number and portions of the plurality of at least partially cut-out portions are located in five of said six lengthwise extending sidewall panels. Two of the central portions are located in one of the six lengthwise extending sidewall panels; three of the central portions are located in another of the six lengthwise extending sidewall panels and one of the central portions is located in a lengthwise extending sidewall panel located between the one and the another of the six lengthwise extending sidewall panels.

A spacer panel is located in each of a plurality of the plurality of spaced apart at least partially cut-out portions and is joined to at least one of the plurality of lengthwise extending sidewall panels by a fold line. Each of the spacer panels has a plurality of equidistantly extending edges. At least two of the plurality of edges terminate at the ends of fold lines between the spacer panel and the associated sidewall panel and are detachably secured to lengthwise extending sidewall panels located on opposite sides of the at least one of the plurality of lengthwise extending sidewall panels by a nicked line.

A preferred method of forming and filling a carton from a carton blank comprising a unitary sheet of a paperboard material having a length and a width; a plurality of cut lines and fold lines in the unitary sheet for dividing the unitary sheet into a plurality of lengthwise extending sidewall panels and a lengthwise extending glue tab panel; an end flap joined to each end portion of each of the plurality of lengthwise extending sidewall panels by a fold line; a plurality of spaced apart at least partially cut-out portions formed in the unitary sheet; and at least a portion of each of the plurality of spaced apart at least partially cut-out portions being located in a widthwise direction in a plurality of the plurality of lengthwise extending sidewall panels; the glue tab panel secured to one of the lengthwise extending sidewall panels; a spacer panel located in each of a plurality of the plurality of spaced apart at least partially cut-out portions and joined to at least one of the plurality of lengthwise extending sidewall panels by a fold line; each of the spacer panels having a plurality of edges; and at least two of the plurality of edges terminating at the ends of the fold line between the at least one of the plurality of lengthwise extending sidewall panels and the spacer panel and detachably secured to lengthwise extending sidewall panels located on opposite sides of the at least one of said plurality of lengthwise extending sidewall panels by a perforated line comprises folding the carton blank around the fold lines between adjacent ones of the plurality of lengthwise extending sidewall panels to form an open ended carton; folding the end flaps located at one end portion and securing the folded end flaps together to form a closed bottom wall and an open top wall; inserting a first filled container through the open top wall and into contact with the closed bottom wall; detaching a first one of the spacer panels and folding the detached first one of the spacer panels into contact with the first filled container; inserting a second filled container through the open top wall and into contact with the first spacer panel; detaching a second one of the spacer panels and folding the detached second one of the spacer panels into contact with the second filled container; repeating the inserting and detaching steps until the carton is filled and folding the end flaps located at the other end portion and securing the folded end flaps together to form a closed top wall.

BRIEF DESCRIPTION OF THE DRAWING

An illustrative and presently preferred embodiment of the invention are illustrated in the drawing in which.

DETAILED DESCRIPTION OF THE INVENTION

Figure 1:
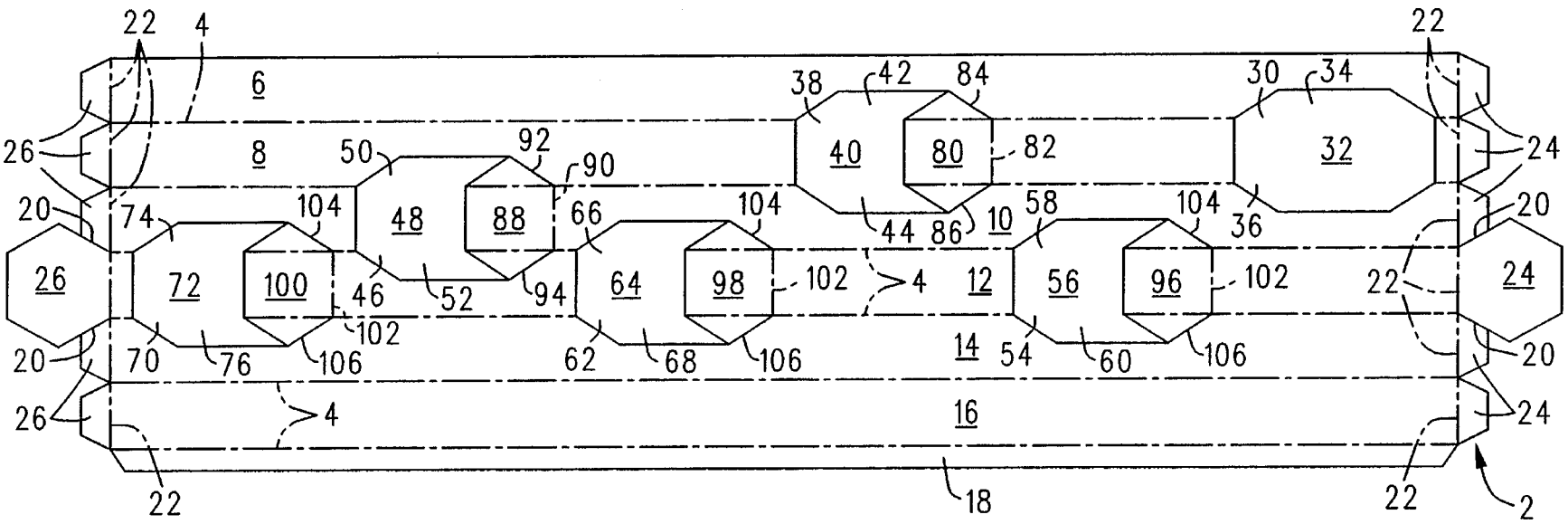
FIG. 1 is a top plan view of a carton blank of this invention.
Figure 2:
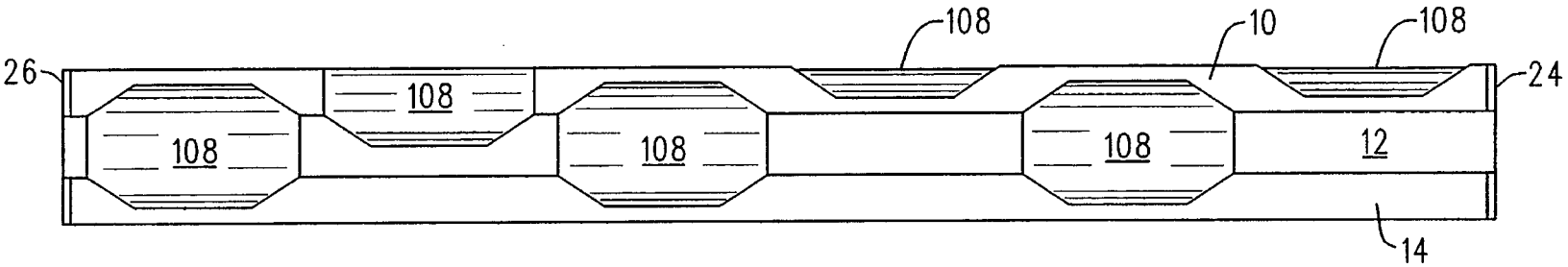
FIG. 2 is a top plan view of a filled carton formed from the carton blank of FIG. 1 of the lengthwise extending sidewall panel having three partially cut-out portions.

In FIG. 1, there is illustrated a carton blank 2 comprising a unitary sheet of a paperboard material. The carton blank 2 has a plurality of fold lines 4 which divide the carton blank 2 into a plurality of lengthwise extending sidewall panels 6, 8, 10, 12, 14 and 16 and a lengthwise extending glue tab panel 18. A plurality of cut lines 20 and fold lines 22 divide the carton blank 2 into bottom end flaps 24 and top end flaps 26.

A fully cut-out portion 30 has a central portion 32 in the lengthwise extending sidewall panel 8, an opposite side portion 34 extending into the lengthwise extending sidewall panel 6 and an opposite side portion 36 extending into the lengthwise extending sidewall panel 10.

A partially cut-out portion 38 has a central portion 40 formed in the lengthwise extending sidewall panel 8 at a distance spaced from the fully cut-out portion 30, an opposite side portion 42 extending into the lengthwise extending sidewall panel 6 and an opposite side portion 44 extending into the lengthwise extending sidewall panel 10.

A partially cut-out portion 46 has a central portion 48 formed in the lengthwise extending sidewall panel 10, an opposite side portion 50 extending into the lengthwise extending sidewall panel 8 and an opposite side portion 52 extending into the lengthwise extending sidewall panel 12.

A partially cut-out portion 54 has a central portion 56 formed in the lengthwise extending sidewall panel 12, an opposite side portion 58 extending into the lengthwise extending sidewall panel 10 and an opposite side portion 60 extending into the lengthwise extending sidewall panel 14.

A partially cut-out portion 62 spaced from the partially cut-out portion 54 has a central portion 64 formed in the lengthwise extending sidewall panel 12, an opposite side portion 66 extending into the lengthwise extending sidewall panel 10 and an opposite side portion 68 extending into the lengthwise extending sidewall panel 14.

A partially cut-out portion 70 spaced from the partially cut-out portion 62 has a central portion 72 formed in the lengthwise extending sidewall 12, an opposite side portion 74 extending into the lengthwise extending sidewall panel 10 and an opposite side portion 76 extending into the lengthwise extending sidewall panel 14.

A spacer panel 80 is joined to the lengthwise extending sidewall panel 8 by a fold line 82 and detachably secured to the lengthwise extending sidewall panels 6 and 10 by nicked lines 84 and 86. A spacer panel 88 is joined to the lengthwise extending sidewall panel 10 by a fold line 90 and detachably secured to the lengthwise extending sidewall panels 8 and 12 by nicked lines 92 and 94. Spacer panels 96, 98 and 100 are joined to the lengthwise extending sidewall panel 12 by fold lines 102 and detachably secured to the lengthwise extending sidewall panels 10 and 14 by nicked lines 104 and 106.

A carton is formed from the carton blank 2 by folding the lengthwise extending sidewall panels 6, 8, 10, 12, 14 and 16 and the glue tab panel 20 around the fold lines 4 and securing the glue tab panel 20 to the lengthwise extending sidewall panel 6. The bottom end flaps 24 are folded around the fold lines 22 and secured together. A beverage container 108 is inserted into the carton and moves into contact with the folded and secured bottom end flaps 24. The spacer panel 96 is detached by breaking the nicked lines 104 and 106 and is folded around the fold line 102. Another beverage container 108 is inserted into the carton and moves into contact with the spacer panel 96 so that the spacer panel is between and in contact with the top of one beverage container 108 and the bottom of the another beverage container 108. This is repeated with each of the spacer panels 80, 98, 88 and 100 until the carton is filled. The top end flaps 26 are folded around the fold lines 22 and are secured together.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed:

1. A carton blank comprising:

a unitary sheet of a paperboard material having a length and a width;

a plurality of cut lines and fold lines in said unitary sheet for dividing said unitary sheet into a plurality of lengthwise extending sidewall panels having opposite end portions and a lengthwise extending glue tab panel;

an end flap joined to each end portion of each of said plurality of lengthwise extending sidewall panels by a fold line;

a plurality of spaced apart at least partially cut-out portions formed in said unitary sheet;

each of said plurality of spaced apart at least partially cut-out portions being space from the next adjacent one of said plurality of spaced apart at least partially cut-out portions in the lengthwise direction; and at least a portion of each of said plurality of spaced apart at least partially cut-out portions being located in a widthwise direction in a plurality of said plurality of lengthwise extending sidewall panels.

2. A carton blank as in claim 1 wherein:

each of said plurality of spaced apart at least partially cut-out portions having a central portion located in one of said plurality of lengthwise extending sidewall panels and opposite side portions located in adjacent ones of said plurality of lengthwise extending sidewall panels.

3. A carton blank as in claim 2 wherein:

a plurality of said central portions being located in at least one of said plurality of lengthwise extending sidewall panels.

4. A carton blank as in claim 1 wherein:

said plurality of lengthwise extending sidewall panels are six in number; and portions of said plurality of at least partially cut-out portions are located in five of said six lengthwise extending sidewall panels.

5. A carton blank as in claim 4 wherein:

each of said plurality of spaced apart at least partially cut-out portions having a central portion located in one of said plurality of lengthwise extending sidewall panels and opposite side portions located in adjacent ones of said plurality of lengthwise extending sidewall panels.

6. A carton blank as in claim 5 wherein:

two of said central portions being located in one of said six lengthwise extending sidewall panels;

three of said central portions being located in another of said six lengthwise extending sidewall panels; and one of said central portions being located in said lengthwise extending sidewall panel located between said one and said another of said six lengthwise extending sidewall panels.

7. A carton blank as in claim 5 and further comprising:

a spacer panel located adjacent to each of said plurality of said plurality of spaced apart at least partially cut-out portions and joined to one of said plurality of lengthwise extending sidewall panels by a fold line;

each of said spacer panels having a plurality of edges; and at least two of said plurality of edges being detachably secured to said lengthwise extending sidewall panels located on opposite sides of said one of said plurality of lengthwise extending sidewall panels by a nicked line.

8. A carton blank as in claim 7 and further comprising:

at least two spaced apart lengthwise extending fold lines in each of said spacer panels.

9. A carton as in claim 8 wherein:

each of said at least two fold lines being in alignment with one of said fold lines between said plurality of lengthwise extending sidewall panels.

10. A carton blank as in claim 1 and further comprising:

a spacer panel located adjacent to each of said plurality of spaced apart at least partially cut-out portions and joined to one of said plurality of lengthwise extending sidewall panels by a fold line;

each of said spacer panels having a plurality of edges; and at least two of said plurality of edges being detachably secured to said lengthwise extending sidewall panels located on opposite sides of said one of said plurality of lengthwise extending sidewall panels by a nicked line.

11. A carton blank as in claim 10 wherein:

each of said plurality of spaced apart at least partially cut-out portions having a central portion located in one of said plurality of lengthwise extending sidewall panels and opposite side portions located in adjacent ones of said plurality of lengthwise extending sidewall panels.

12. A carton blank as in claim 10 wherein:

a plurality of said central portions being located in at least one of said plurality of lengthwise extending sidewall panels.

13. A carton blank as in claim 12 wherein:

said plurality of lengthwise extending sidewall panels are six in number; and portions of said plurality of at least partially cut-out portions are located in five of said six lengthwise extending sidewall panels.

14. A carton blank as in claim 13 wherein:

each of said plurality of spaced apart at least partially cut-out portions having a central portion located in one of said plurality of lengthwise extending sidewall panels and opposite side portions located in adjacent ones of said plurality of lengthwise extending sidewall panels.

15. A carton blank as in claim 14 wherein:

two of said central portions being located in one of said six lengthwise extending sidewall panels;

three of said central portions being located in another of said six lengthwise extending sidewall panels; and one of said central portions being located in said lengthwise extending sidewall panel located between said one and said another of said six lengthwise extending sidewall panels.

16. A carton blank as in claim 14 and further comprising:

at least two spaced apart lengthwise extending fold lines in each of said spacer panels.

each of said at least two fold lines being in alignment with one of said fold lines between said plurality of lengthwise extending sidewall panels.

17. A carton blank as in claim 10 and further comprising:

at least two spaced apart lengthwise extending fold lines in each of said spacer panels.

18. A carton blank as in claim 17 wherein:

each of said at least two fold lines being in alignment with one of said fold lines between said plurality of lengthwise extending sidewall panels.

* * * * *